US009890523B2

(12) United States Patent
Ball

(10) Patent No.: US 9,890,523 B2
(45) **Date of Patent: *Feb. 13, 2018**

(54) STRAINER WITH IMPROVED FLOW

(71) Applicant: WCM Industries, Inc., Colorado Springs, CO (US)

(72) Inventor: William T. Ball, Colorado Springs, CO (US)

(73) Assignee: WCM INDUSTRIES, INC., Colorado Springs, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/438,848

(22) Filed: Feb. 22, 2017

(65) Prior Publication Data

US 2017/0159274 A1 Jun. 8, 2017

Related U.S. Application Data

(63) Continuation of application No. 14/208,970, filed on Mar. 13, 2014, now Pat. No. 9,637,897.

(60) Provisional application No. 61/780,206, filed on Mar. 13, 2013.

(51) Int. Cl.
*E03C 1/262* (2006.01)
*E03C 1/264* (2006.01)

(52) U.S. Cl.
CPC ..... *E03C 1/262* (2013.01); *E03C 1/264* (2013.01)

(58) Field of Classification Search
CPC ..... E03C 1/22; E03C 1/23; E03C 1/26; E03C 1/262; E03C 1/264
USPC ..... 4/292, 286, 287, 288
See application file for complete search history.

(56) References Cited

U.S. PATENT DOCUMENTS

| | | | |
|---|---|---|---|
| 287,246 | A | 10/1883 | Coomber |
| 765,131 | A | 7/1904 | Croswell |
| 917,395 | A | 4/1909 | Wise |
| 1,511,017 | A | 10/1924 | Binder |
| 2,695,678 | A | 11/1954 | Sisk |
| 3,393,409 | A | 7/1968 | Politz |
| 4,138,747 | A | 2/1979 | Zijlstra |
| 5,692,248 | A | 12/1997 | Ball |
| 5,758,368 | A | 6/1998 | Ball |
| 6,226,806 | B1 | 5/2001 | Ball |
| 6,317,906 | B1 | 11/2001 | Ball |
| 6,418,570 | B1 | 7/2002 | Ball |
| 7,150,576 | B1 | 12/2006 | Kambeyanda |
| 2006/0064809 | A1 | 3/2006 | Isgro |
| 2010/0000012 | A1 | 1/2010 | Evans |
| 2010/0275364 | A1 | 11/2010 | Torres et al. |
| 2014/0053328 | A1 | 2/2014 | Chen |
| 2014/0259346 | A1 | 9/2014 | Ball |

OTHER PUBLICATIONS

Official Action for U.S. Appl. No. 14/208,970, dated Aug. 13, 2015, 15 pages.
Official Action for U.S. Appl. No. 14/208,970, dated Jan. 14, 2016, 10 pages.

(Continued)

*Primary Examiner* — Erin Deery
(74) *Attorney, Agent, or Firm* — Merchant & Gould P.C.

(57) ABSTRACT

A wastewater strainer is provided that includes a strainer body that has at least one opening that enhances fluid flow through the strainer body and the wastewater plumbing to which it is interconnected. The strainer body includes a flange for engagement to the inner portion of a bathtub and a hub that is spaced from a lower edge of the strainer body.

18 Claims, 5 Drawing Sheets

(56) References Cited

OTHER PUBLICATIONS

Official Action for U.S. Appl. No. 14/208,970, dated May 25, 2016, 11 pages.
Official Action for U.S. Appl. No. 14/208,970, dated Sep. 19, 2016, 17 pages.
Notice of Allowance for U.S. Appl. No. 14/208,970, dated Dec. 27, 2016, 8 pages.

STRAINER WITH IMPROVED FLOW

This U.S. Non-Provisional application claims the benefit of U.S. patent application Ser. No. 14/208,970, filed Mar. 13, 2014, now U.S. Pat. No. 9,637,897, and U.S. Provisional Patent Application Ser. No. 61/780,206, filed Mar. 13, 2013, the entire disclosures of which are incorporated by reference herein.

FIELD OF THE INVENTION

Embodiments of the present invention are generally related to wastewater strainers commonly found in bathtubs and other fluid-holding basins. Strainers are located at a low point of the bathtub and interconnect to a wastewater drain system associated with a drain port of the bathtub and provide a fluid conduit from the bathtub or basin to the wastewater drain system.

BACKGROUND OF THE INVENTION

Wastewater plumbing is interconnected to a bathtub, shower, or other fluid-holding basin (hereinafter "bathtub") by way of a strainer that prevents large items from entering the wastewater plumbing system. The strainer also accommodates a drain stopper. Referring now to FIG. 3, strainers 2 generally include an externally threaded 10 cylindrical body 6 with an outwardly extending flange 22. Strainers 2 also often include at least one arm 54 that extends from an inner surface 56 of the cylindrical body 6. The arm 54 or arms support a centrally-located hub 30. The hub 30 receives a post or carrier that operatively supports the drain stopper. Common strainers and drain stoppers are described in U.S. Pat. Nos. 5,758,368 and 6,418,570, the entirety of which are incorporated by reference herein.

Wastewater plumbing often includes a generally L-shaped elbow 18 having a flange 38 extending from its upper surface for contacting a bottom surface of the bathtub. The other end, i.e., a generally "horizontal portion 50 of the elbow, is interconnected to a pipe that extends generally parallel to the outer, lower surface of the bathtub. To interconnect the wastewater elbow 18 to the bathtub, the elbow flange 38 is placed adjacent to the bottom surface of the bathtub wherein a seal 42 is often positioned therebetween. The strainer 2 is then inserted into the drain outlet and external threads 10 are interconnected to internal threads 14 of the drain elbow. As the strainer 2 is tightened onto the elbow 18, the strainer flange 22 will engage the bottom, internal surface of the bathtub to secure the wastewater elbow and associated plumbing to the bathtub.

Because the strainer body 6 is often longer than the upper portion of the elbow that interfaces with the bathtub 52, a portion of the strainer body will obstruct the wastewater flow path defined by the inner surface of the horizontal portion 50 of the elbow 18. Stated differently, the strainer body 6 when interconnected to the elbow 18 will extend past the intersection of the upper portion 52 and the horizontal portion 50 of the elbow, which obstructs flow. As one of skill in the art will appreciate, the more the strainer body extends past the intersection, the greater the flow obstruction as fluid leaving the bathtub must first circumvent the strainer body sidewall before it can enter the horizontal portion of the elbow. Flow obstructions prevent water from quickly escaping the bathtub, which is not ideal in overflow situations, for example, when users rely on opening a drain stopper to quickly drain the bathtub.

Thus, it has been a long felt need in the field of plumbing to provide a wastewater strainer that enhances fluid flow from the bathtub. The following disclosure describes an improved strainer that minimizes obstructions commonly found in strainer/elbow interconnections.

SUMMARY OF THE INVENTION

It is one aspect of embodiments of the present invention to provide a wastewater strainer ("hereinafter "strainer") that enhances fluid flow from a bathtub or other fluid-holding basin. The contemplated strainer includes a strainer body and a flange extending from a top edge of the strainer body. The strainer also includes a hub supported by at least one arm. The hub receives a post or carrier that operatively receives a drain stopper that cooperates with the flange to prohibit fluid flow from the bathtub. Enhanced flow is provided by decreasing the strainer body length while maintaining the distance from the hub to the strainer flange. Extensions are provided that offset the arms from a lower edge of the strainer body, which allows the distance between the hub and strainer flange to be maintained. The distance between the hub and the strainer flange is, in some respects, important because stopper mechanisms in use require predetermined carrier length to function properly and, if the hub location is raised relative to the inner surface of the bathtub, the stopper will not engage the strainer flange to seal the bathtub. By shortening the strainer body, at least two openings in the strainer body sidewall are provided that coincide with the fluid conduit provided by the horizontal portion of the wastewater elbow. Thus, fluid flowing through the strainer body will flow directly from the strainer body to the horizontal portion of the elbow without having to circumvent the strainer body sidewall.

It is another aspect of the present invention to provide a wastewater strainer, comprising: a body having an upper edge and a lower edge; a flange extending from the upper edge; at least one extension extending from the lower edge; and an arm interconnected on a first end to the extension and on a second end to a hub positioned within the body.

It is still yet another aspect of the present invention to provide a wastewater strainer used in combination with drain plumbing associated with a water receptacle, comprising: a body adapted to fit within a first portion of an elbow, the body having an upper edge and a lower edge and including an opening associated with the lower edge, the opening generally coinciding with the inner diameter of a second portion of the elbow such that a fluid flow path from the body and the second portion of the elbow is generally unobstructed; and a flange extending from the upper edge of the cylindrical body.

The Summary of the Invention is neither intended nor should it be construed as being representative of the full extent and scope of the present invention. Moreover, references made herein to "the present invention" or aspects thereof should be understood to mean certain embodiments of the present invention and should not necessarily be construed as limiting all embodiments to a particular description. The present invention is set forth in various levels of detail in the Summary of the Invention as well as in the attached drawings and the Detailed Description of the Invention and no limitation as to the scope of the present invention is intended by either the inclusion or non-inclusion of elements, components, etc. in this Summary of the Invention. Additional aspects of the present invention will become more readily apparent from the Detail Description, particularly when taken together with the drawings.

BRIEF DESCRIPTION OF THE DRAWINGS

The accompanying drawings, which are incorporated in and constitute a part of the specification, illustrate embodiments of the invention and together with the general description of the invention given above and the detailed description of the drawings given below, explain the principles of these inventions.

Figure 1:
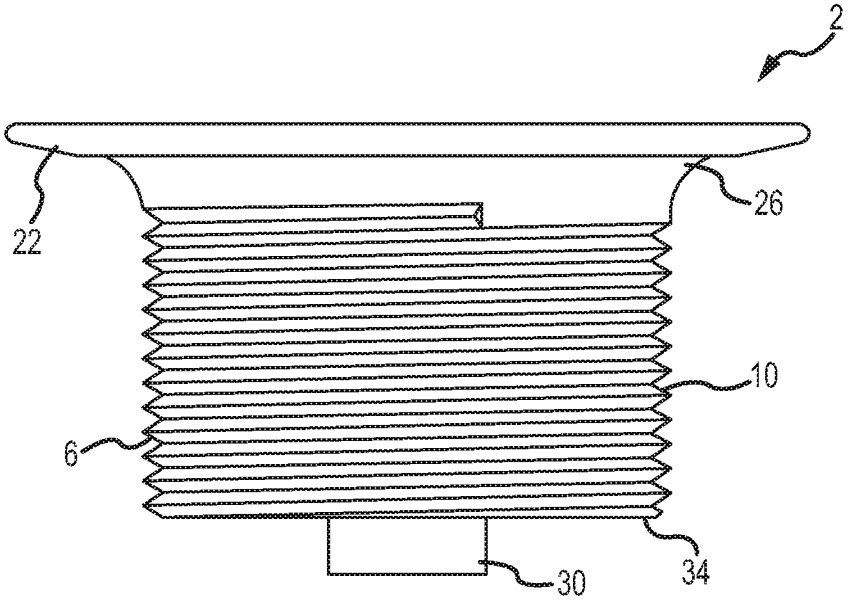
FIG.1 (PRIOR ART)
FIG. 1 is a front elevation view of a strainer of the prior art.

To assist in the understanding of one embodiment of the present invention the following list of components and associated numbering found in the drawings is provided herein:

| # | Component |
|---|---|
| 2 | Strainer |
| 6 | Strainer body |
| 10 | External threads |
| 14 | Internal threads |
| 18 | Drain elbow |
| 22 | Strainer flange |
| 26 | Upper edge |
| 30 | Hub |
| 34 | Lower edge |
| 38 | Drain flange |
| 42 | Seal |
| 46 | Conduit |
| 50 | Horizontal portion |
| 52 | Upper portion |
| 54 | Arm |
| 56 | Inner surface |
| 58 | Extension |
| 62 | Openings |
| 66 | Inner wall |
| 70 | Vertical portion |
| 74 | Hole |

It should be understood that the drawings are not necessarily to scale. In certain instances, details that are not necessary for an understanding of the invention or that render other details difficult to perceive may have been omitted. It should be understood, of course, that the invention is not necessarily limited to the particular embodiments illustrated herein.

DETAILED DESCRIPTION

Figure 2:
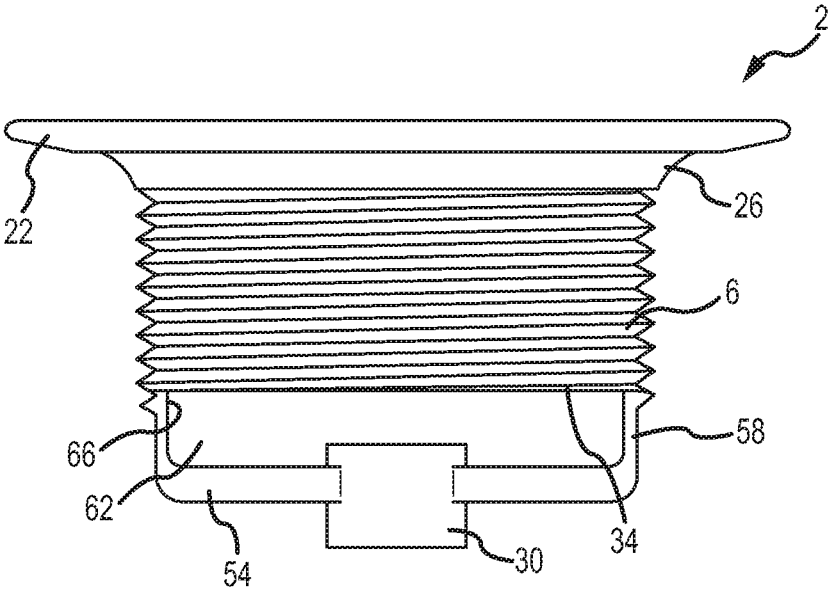
FIG. 2 is a front elevation view of a strainer of one embodiment of the present invention.
Figure 4:
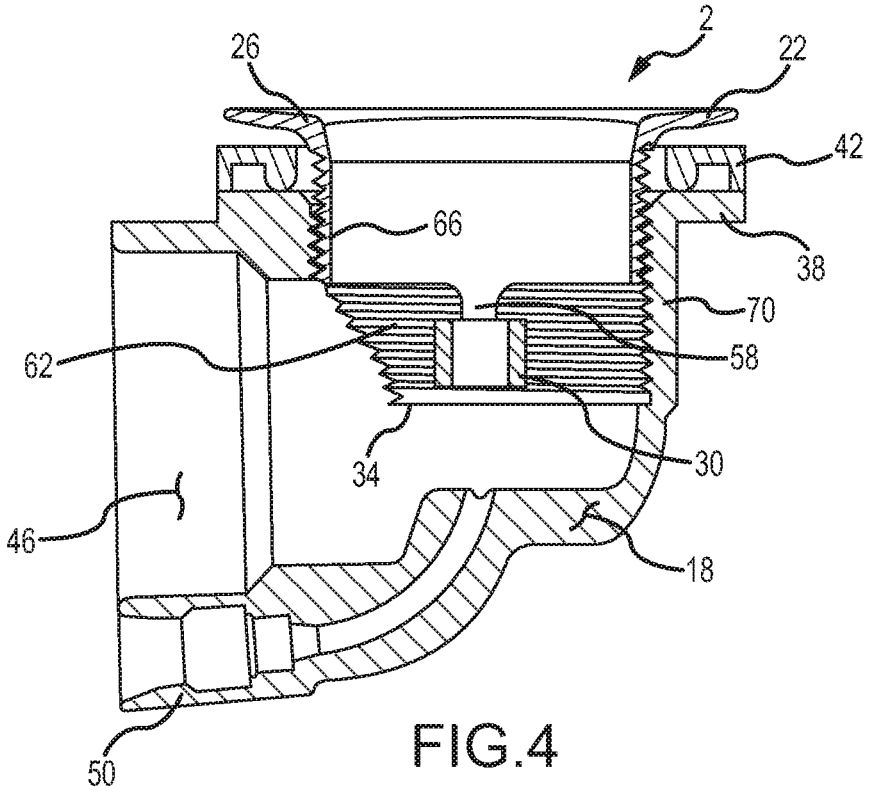
FIG. 4 is a cross-sectional view of the strainer of one embodiment of the present invention interconnected to an elbow of a wastewater plumbing system.
Figure 5:
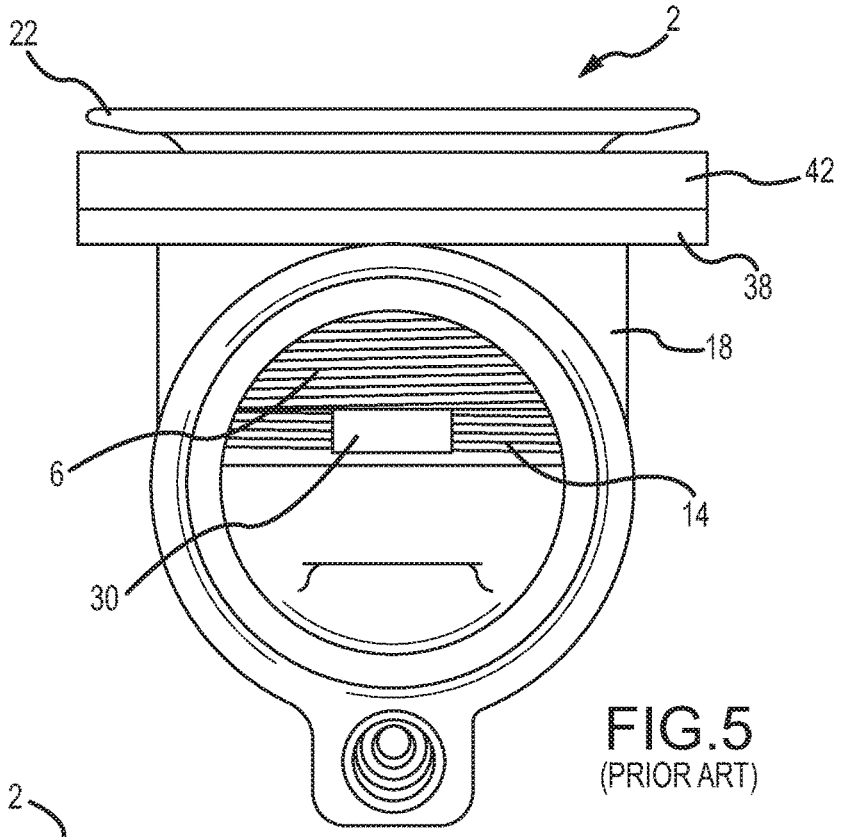
FIG.5 (PRIOR ART)
FIG. 5 is a left elevation view of the strainer of the prior art interconnected to an elbow of a wastewater plumbing system.
Figure 6:
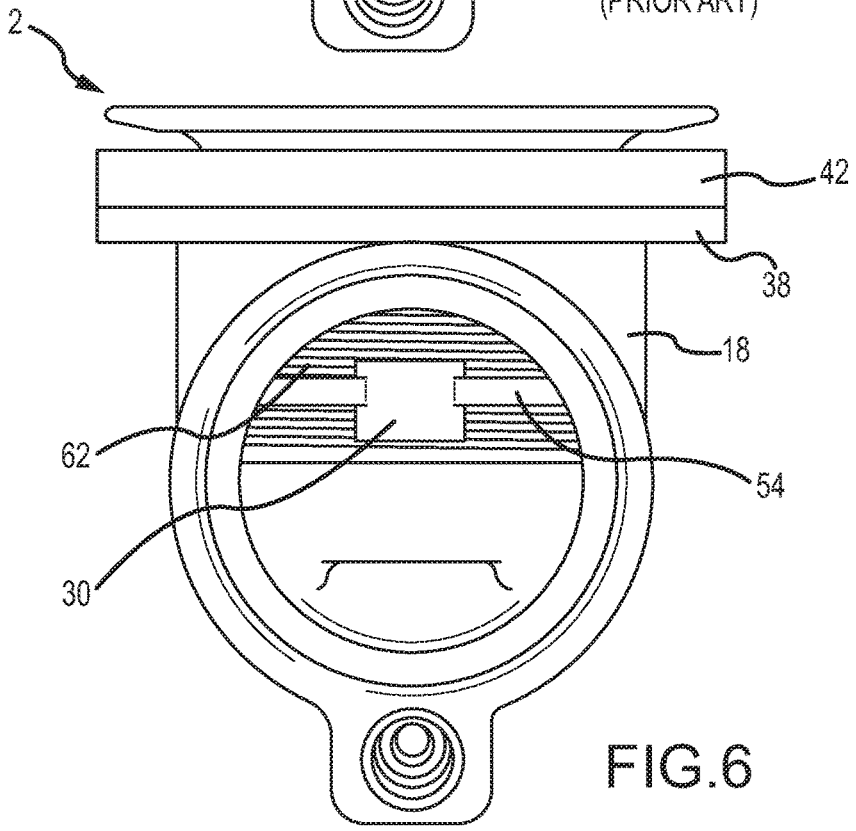
FIG. 6 is a left elevation view of the strainer of one embodiment of the present invention interconnected to an elbow of a wastewater plumbing system.
Figure 7:
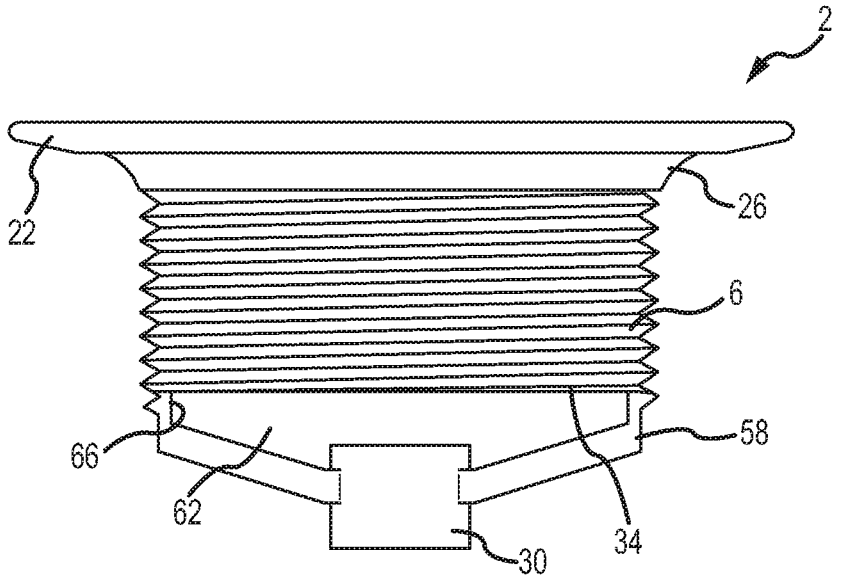
FIG. 7 is a side elevation view of one embodiment of the present invention that employs angled extensions.

FIGS. 2, 4, and 6 show a wastewater strainer 2 of one embodiment of the present invention that includes a strainer body 6 with external threads 10. The external threads 10 are designed to engage internal threads 14 of an elbow 18 of a wastewater plumbing system. The strainer 2 also includes a flange 22 positioned at an upper edge 26 of the strainer 2 and a hub 30 positioned adjacent its lower edge 34. The hub 30 receives a post or carrier associated with a drain stopper.

Figure 3:
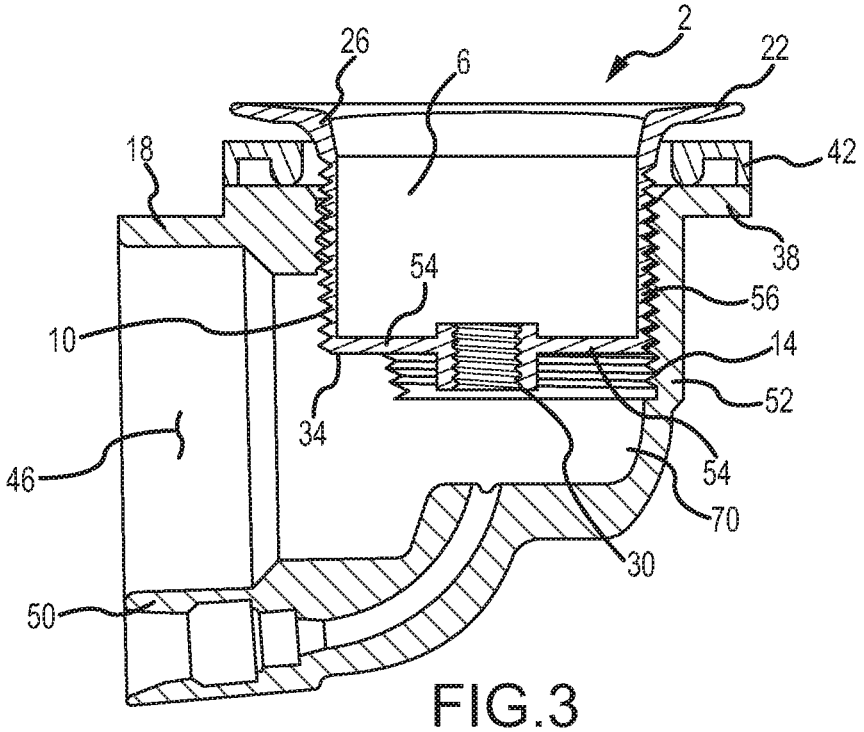
FIG.3 (PRIOR ART)
FIG. 3 is a cross-sectional view of the strainer of the prior art interconnected to an elbow of a bath wastewater plumbing system.

FIGS. 3 and 6 show the interconnection of a prior art strainer to an elbow that is positioned adjacent to the bottom portion of a bathtub (not shown) with a seal 42 positioned between the drain flange 38 and the bottom surface of the bathtub. To secure the drain elbow 18 and associated wastewater plumbing to the bathtub, the strainer 2 is first placed in a drain port of the bathtub and threadingly engaged into the elbow 18. As the strainer 2 is tightened onto the elbow 18, the strainer flange 22 will engage an inner bottom surface of the bathtub and compress the seal 42 to sandwich the bathtub wall between the strainer flange 22 and the drain flange 38. After this connection is complete, the drain stopper assembly (not shown) is interconnected to the hub 30.

As shown in FIG. 3, water flowing through the prior art strainer 2 would necessarily have to circumvent the lower edge 34 of the strainer body 6 to enter a conduit 46 provided by a generally horizontal portion 50 of the drain elbow 18. Again, this obstruction reduces mass flow through the drain elbow 18, which is undesirable.

FIGS. 2, 4, and 6 show one embodiment of the present invention that addresses the fluid flow problems previously described herein. More specifically, the strainer body 6 is shorter relative to the strainer body length of the prior art wherein the location of the hub 30 relative to the strainer flange 22 is maintained. That is, the location of the hub 30 and associated arms 54 with respect to the strainer flange 22 is maintained by extensions 58 interconnected to the lower edge 34 of the strainer body. This arrangement maintains the position of the hub 30 relative to the flange and creates openings 62 in the strainer body 6 that will allow water to flow more effectively.

FIGS. 4 and 6 show the interconnection of the strainer body of one embodiment. In operation, the strainer body 2 is threaded into the drain elbow 18 as in the prior art. Here, however, after interconnection, the lower edge 34 of the strainer body 6 is positioned close to an inner wall 66 of the horizontal portion 50 of the drain elbow 18. Thus, the arms 54 and hub 30 of the strainer body 6 create the only substantial flow obstruction and fluid does not have to circumvent an extended side wall of the strainer body to enter the conduit 16. The rotational position of the strainer relative to the elbow is irrelevant as at least two openings 62 are provided that allow the water to flow directly from the strainer body 6 to the horizontal portion 50 of the drain elbow 18.

One of skill in the art will also appreciate that the arms/extensions do not have to be formed in a 90° configuration as shown. More specifically, the arms 54 may be angled relative to the hub 30 and the inner wall 66 of the strainer body 6. In addition, one of skill in the art will appreciate that although two arms 54 are provided, more or less arms may be used without departing from the scope of the invention. For example, to prevent items from falling into the drain system, more arms 54 can be provided.

Alternatively, a single arm cantilevered from the extension may be provided to further increase the flow through the strainer body.

Although the openings are shown as providing a strainer body 6 with a relatively planar lower edge 34, one of skill in the art will appreciate that any strainer body 6 that has extensions 58 and that space the hub 30 away from the strainer flange 22 is contemplated. More specifically, the openings 62 may have an arcuate profile such that only the portion above the extensions has threads that engage the threads 14 of the drain elbow 18. In this fashion, the majority of the sidewall associated with the strainer body 6 would be removed. That is, any configuration that removes portions of the strainer body 6, while providing sufficient threads 10 for securely engaging with the threads 14 of the drain elbow 18 is contemplated and is within the scope of the present invention.

Figure 8:
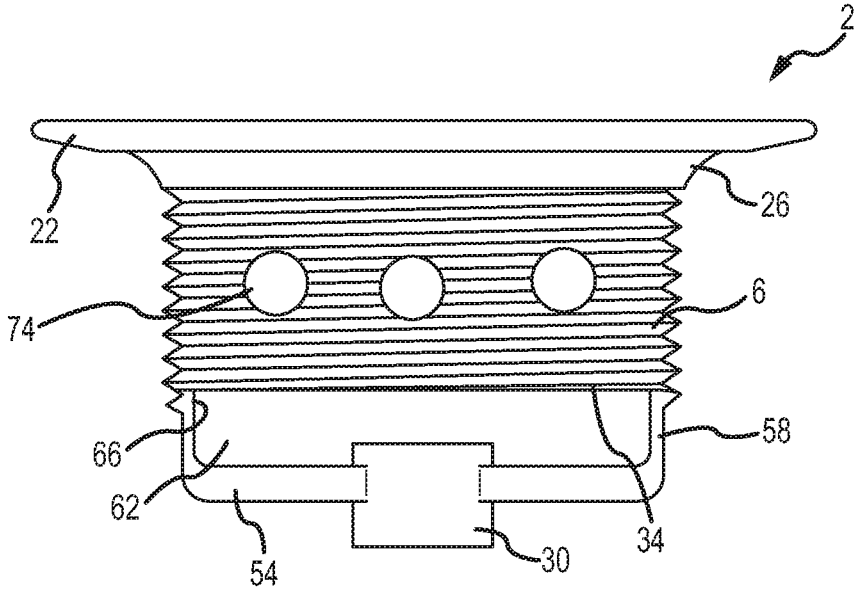
FIG. 8 is a side elevation of one embodiment of the present invention that employs a sidewall with a plurality of holes.

Further, as provided in FIG. 1, some embodiments employ extensions that directly interconnect to the hub. In these embodiments, the extensions are angled downwardly to position the hub at the correct distance below the strainer flange. Some other embodiments of the present invention as shown in FIG. 8 employ sidewalls with a plurality of holes that facilitate fluid flow. Here, although a traditional sidewall is used, the plurality of holes decreases the amount of fluid that must circumvent the sidewall.

While various embodiments of the present invention have been described in detail, it is apparent that modifications and alterations of those embodiments will occur to those skilled in the art. However, it is to be expressly understood that such modifications and alterations are within the scope and spirit of the present invention, as set forth in the following claims. Further, the invention(s) described herein is capable of other embodiments and of being practiced or of being carried out in various ways. In addition, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

What is claimed is:

1. A wastewater strainer operable to be provided in a drain elbow, the wastewater strainer comprising:

a body having an upper edge and a lower edge, and at least a portion of the body comprising a sidewall;

a flange extending from said upper edge;

at least one extension extending downwardly from the lower edge away from the flange;

an arm interconnected on a first end to said at least one extension and on a second end to a centrally-located hub positioned below the lower edge of said body, the hub having an aperture adapted to receive a threaded post or carrier associated with a drain stopper;

wherein said hub is provided in a fixed position relative to the body by the at least one extension, and wherein at least one opening for fluid flow is provided between the lower edge of the body and the hub;

wherein the hub comprises a thickness that is greater than a thickness of the arm; and a plurality of holes extending through the sidewall of the body, the plurality of holes operable to decrease the amount of fluid that must circumvent the sidewall.

2. The wastewater strainer of claim 1, wherein a distance between a lower surface of said flange and said lower edge of said body is between 0.25 inches and 1.0 inches.

3. The wastewater strainer of claim 1, wherein a distance between said lower edge of said body and a bottom surface of said hub is at least 0.5 inches.

4. The wastewater strainer of claim 1, wherein the at least one extension comprises first and second extensions.

5. The wastewater strainer of claim 1, wherein the sidewall of the body comprises external threads.

6. The wastewater strainer of claim 1, wherein said at least one extension is angled relative to said flange.

7. A wastewater strainer, comprising:

a body having an upper edge and a lower edge;

a flange;

at least one extension extending from said lower edge;

a hub spaced apart from said lower edge of said body, said hub being interconnected to said at least one extension, and said hub having an aperture adapted to receive a threaded post;

wherein a distance between a lower surface of said flange and said lower edge of said body is between 0.25 inches and 1.0 inches, and wherein the wastewater strainer is operable to be provided in a drain elbow;

a hole extending through a sidewall of the body, the hole operable to decrease the amount of fluid that must circumvent the sidewall; and wherein said hub is provided in a fixed position relative to the body by the at least one extension, and wherein at least one opening for fluid flow is provided between the lower edge of the body and the hub.

8. The wastewater strainer of claim 7, wherein said body is threaded.

9. The wastewater strainer of claim 7, wherein said at least one extension is angled relative to said flange.

10. The wastewater strainer of claim 7, wherein a distance between said lower edge of said body and a bottom surface of said hub is at least 0.5 inches.

11. The wastewater strainer of claim 7, wherein the flange extends outwardly from said upper edge.

12. A wastewater strainer comprising:

a body having an upper edge and a lower edge, and at least a portion of the body comprising a sidewall;

a flange extending from the upper edge;

at least one extension connected to at least a portion of the lower edge;

an arm interconnected on a first end to the at least one extension and on a second end to a centrally-located hub positioned below at least a portion of the lower edge of the body, said hub having an aperture adapted to receive a threaded post or carrier associated with a drain stopper, wherein the hub is provided in a fixed position relative to the body by the at least one extension, and wherein at least one opening for fluid flow is provided between at least a portion of the lower edge of the body and the hub; and at least one additional opening that is at least partially defined within the sidewall.

13. The wastewater strainer of claim 12, wherein a distance between a lower surface of the flange and the lower edge of the body is between 0.25 inches and 1.0 inches.

14. The wastewater strainer of claim 12, wherein the body is threaded.

15. The wastewater strainer of claim 12, wherein the at least one extension is angled relative to the flange.

16. The wastewater strainer of claim 12, wherein a distance between the lower edge of the body and a bottom surface of the hub is at least 0.5 inches.

17. The wastewater strainer of claim 12, wherein the at least one extension comprises a first extension and a second extension.

18. The wastewater strainer of claim 12, wherein the flange extends from the upper edge of the body.

* * * * *